United States Patent [19]

McMillon

[11] Patent Number: 4,509,282

[45] Date of Patent: Apr. 9, 1985

[54] SIGHT AND SCOPE CONVERSION MOUNTING

[75] Inventor: Carlos H. McMillon, Vandalia, Ohio

[73] Assignee: Mack's Guns, Vandalia, Ohio

[21] Appl. No.: 505,907

[22] Filed: Jun. 20, 1983

[51] Int. Cl.[3] ..... F41G 1/38

[52] U.S. Cl. ..... 42/1 ST; 33/245; 33/261

[58] Field of Search ..... 42/1 S, 1 ST, 1 SR; 33/245, 261

[56] References Cited

U.S. PATENT DOCUMENTS

| | | | |
|---|---|---|---|
| 2,763,930 | 9/1956 | Ivy | 33/245 |
| 3,463,430 | 8/1969 | Rubin et al. | 33/245 |
| 3,555,687 | 1/1971 | Joseph | 33/245 |
| 3,556,889 | 1/1971 | Grahn | 42/1 SR |
| 3,835,565 | 9/1974 | Weast | 42/1 ST |
| 3,875,675 | 4/1975 | Krisay | 42/1 ST |
| 4,000,574 | 1/1977 | Grant | 42/1 SR |
| 4,026,055 | 5/1977 | Weast | 42/1 ST |

*Primary Examiner*—Charles T. Jordan
*Attorney, Agent, or Firm*—Becker & Becker, Inc.

[57] ABSTRACT

A unitary metal base substantially rectangular shaped in planar configuration though having a curved upper surface in intermediate location provided with mounting screw holes therein to receive screws for fastening thereof on firearms including rifles, shotguns, pump-guns and automatic weapons having at least one barrel and stock longitudinally spaced from each other as joined to an intermediate firing mechanism. A scope is held by front and rear scope-support loop pieces secured on the unitary metal base in axially and longitudinally aligned loop portions thereof spaced parallel above the base. A flattened, reduced-size end is integral with the base and is recessed to receive in combination therewith a front sight member including a longitudinal rib and aiming projection, an elevated and enlarged end integrally joined to the base at a location axially and longitudinally remote from the reduced-size end. The enlarged end has T-shaped recessing complementary to receive also in combination therewith a rear sight member with a transverse groove carrying a downwardly notched transverse plate in the transverse groove. A continuous rail-like rib projects downwardly and extends accurately longitudinally aligned along an underside of the base from end to end thereof for complementary fixation on the upper surface of the intermediate firing mechanism.

10 Claims, 8 Drawing Figures

SIGHT AND SCOPE CONVERSION MOUNTING

The present invention relates to weaponry and particularly to fire arms made more accurate in hitting a target by provision of a sight and scope conversion mounting along an intermediate upper location of a weapon such as a rifle having a barrel and a stock longitudinally spaced relative to the sight and scope conversion mounting which is independent thereof.

BACKGROUND OF THE INVENTION

1. Field of the Invention

The sight and scope conversion mounting according to the present invention can be used on all Remington, Mossberg, Browning, Bretta & Franchie, Savage, Winchester, "pumps" and automatic weapons. The sight and scope conversion mounting may also be used on all double barrels with solid ribs, all high powered rifles, "pumps" and automatics and any others with a solid rib, including all "pumps" and automatic shotguns of 12 GA., 16 GA., 20 GA., and 410 GA..

2. Description of the Prior Art

U.S. Pat. No. D-209,049-Holden dated Oct. 31, 1967 for a Gun having a telescopic sight mount as a scope mount includes commercially available parts usable and installable upon the sight and scope conversion mounting according to the present invention. U.S. Pat. No. 3,463,430-Rubin dated Aug. 26, 1969 discloses a mounting for a rifle telescopic sight including a lower mounting plate and cradle for raising the scope above the line of vision through conventional fixed sights on the gun itself. U.S. Pat. No. 3,835,565-Weast dated Sept. 17, 1974 shows a sight on the gun barrel and not on a base plate. U.S. Pat. No. 2,763,930-Ivy dated Sept. 25, 1956 discloses a mounting for a scope having sights arranged with scope-mounting straps per se but not on the mounting bar itself. U.S. Pat. No. 4,026,055 shows a barrel having an iron sight close to a telescopic sight. Other references, including U.S. Pat. No. 3,875,675-Krisay dated Apr. 8, 1975 and U.S. Pat. No. 3,555,687-Joseph dated Jan. 19, 1971, generally disclose other types of scope mounting devices which include provisions for utilizing conventional sights. None of the prior art references shows specifically a sight and scope conversion mounting bar having an iron sight itself in combination with such mounting bar per se in a structural arrangement of the present invention that improves accuracy and permits correct orientation and alignment at all times by having front and rear sights directly in combination with the sight and scope conversion mounting bar.

SUMMARY OF THE INVENTION

An object of the present invention is to provide a precision-made aluminum base or bar used as a sight and scope conversion mounting on a rifle as well as all "pumps" and automatic shotguns of various gauges listed in the foregoing outline of the field of invention and used with a substantially rectangular configuration having a downwardly protruding portion or rail precisely made for accuracy in longitudinal alignment with the base itself and having multiple holes drilled and/or tapped therein for mounting purposes at an upper location on the gun and intermediate the barrel and stock of the gun though independent of the barrel as well as the stock.

This object, and other objects and advantages of the present invention, will appear more clearly from the following specification in connection with the accompanying drawings, in which:

DESCRIPTION OF PREFERRED EMBODIMENT

Figures 1, 2, 3, 4, 5, 6, 7, 8:
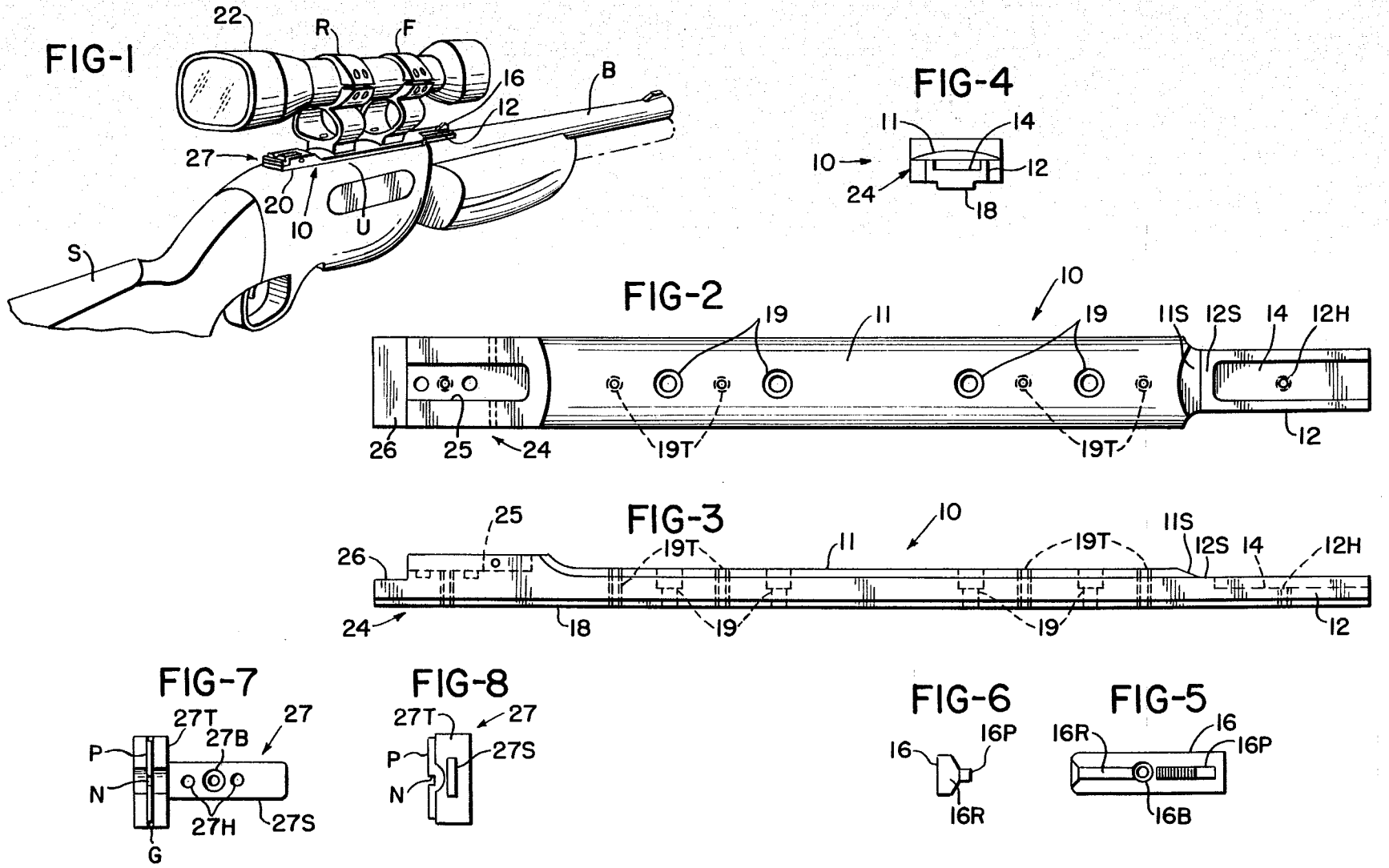
FIG. 1 is a fragmentary perspective view of a weapon having a sight and scope conversion mounting installed at an upper location thereof intermediate a barrel and stock.
FIG. 2 is a top plan view of the sight and scope conversion mounting having features according to the present invention.
FIG. 3 is a side elevational view of the sight and scope conversion mounting of FIG. 1.
FIG. 4 is an end view of the sight and scope conversion mounting of the foregoing views.
FIG. 5 is a plan view of a front sight member that fits one recessed end of the sight and scope conversion mounting of the foregoing views.
FIG. 6 is a end view of the front sight member of FIG. 5.
FIG. 7 is a plan view of a rear sight member that fits another recessed end of the sight and scope conversion mounting of the foregoing views.
FIG. 8 is an end view of the rear sight member of FIG. 7.

Referring now the the drawings in detail, FIG. 1 shows a sight and scope conversion mounting generally indicated by reference 10 at a substantially central location 20 on an upper portion U approximately intermediate a gun barrel B and a gun stock S. The sight and scope conversion mounting 10 is an aluminum base or bar having a curved top portion 11 and a flattened reduced—(in width and height) size end 12 which is recessed at 14 longitudinally thereof to receive a front sight member 16 of plastic, substantially T-shaped in cross section including a longitudinally rib 16R and upward protrusion or aiming projection 16P. A suitable countersunk bore 16B extends through the front sight member 16 substantially centrally thereof to receive a non-illustrated head screw that threads into a tapped hole 12H in the flattened, reduced-size end 12 in accurate longitudinal alignment therewith as fixed and secured in the recess 14. A slanted portion 11S exists between an upper surface 12S of the flattened, reduced-size end 12 and the curved top portion 11 of the aluminum base or bar.

The aluminum base or bar of the sight and scope conversion mounting 10 includes a downwardly extending projection, bar or rib 18 squared for rigidity along the entire length of the underside thereof as well as a multiplicity of countersunk holes 19 through which non-illustrated head screws are installed and threaded into tapped holes longitudinally aligned along a top side of the upper portion U of the gun, rifle or weapon. A multiplicity of threaded holes 19T receive non-illustrated small, headed screws in front and rear pairs securing substantially "figure 8" shaped plastic front and rear sight-scope members F and R per se according to aforementioned U.S. Pat. No. D-209,049-Holden dated Oct. 31, 1967 for precision positioning a securing of a scope 22 axially through aligned openings thereof as well as substantially parallel to though spaced above the aluminum base or bar of the sight and scope conversion mounting 10 accurately mounted atop the shotgun, rifle or weapon.

A lower loop of each of the "figure 8" shaped front and right sight-scope members F and R serves for purposes of sighting or aiming as to projection 16P and rib 16R centered in location as to a notch N of a metal plate P press-fitted or wedged in a transverse slot or groove G of a T-shaped plastic rear sight member 27 having a stem portion 27S and a cross or transverse portion 27T. A pair of holes 27H spaced from each other longitudinally of the stem portion and a countersunk tapped or threaded bore 27B therebetween are provided for securing the T-shaped member 27 in a complementary T-shaped recess 25, 26 of an elevated and enlarged end 24 of the aluminum base or bar of the sight and scope mounting 10 according to the present invention.

The plastic front sight member 16 fits in the recess 14 at one end of the aluminum base or bar of the sight and scope mounting 10 and the plastic rear sight member 27 fits in the recessing 25–26 of the elevated and enlarged end 24 thereof to form an integral unit of highly accurate interconnection therebetween due to the one-piece construction of the aluminum base or bar of the sight and scope mounting as a combination including the rail 18 longitudinally therebelow for the full length thereof. The aluminum mounting bar or base is precision made having substantially rectangular configuration in plan view thereof with the downwardly protruding portion or rail 18 precisely machined for accuracy in longitudinal alignment with the base itself and having multiple holes drilled and/or tapped therein for mounting purposes. All four of the black plastic parts mounted on the aluminum base are commercially available. The aluminum base or bar assures accurate positioning of the scope-mounting plastic "figure 8" pieces and fixed mounting upon an intermediate location of a gun or rifle along the top side thereof between the barrel B and gun stock S. The axially and longitudinally aligned lower loops of a pair of "figure 8" pieces fixed to the unitary aluminum base mounting in combination with the front and rear sight members fixed also to the same unitary aluminum base guarantees accuracy of the entire unit irrespective of the length of the barrel and/or configuration of the gun stock when a target is sighted using the notch N and projection 16P. A scope mounting in the axially and longitudinally aligned upper loops of a pair of "figure 8" pieces fixed to the unitary aluminum base mounting is also guaranteed the same high accuracy of the entire unit irrespective of the length of the barrel B and/or configuration of the gun stock S. The pair of "figure 8" front piece F and rear piece R can be interchanged for pieces having at least one pair of upper loops of different diameter or bore to receive fixed mounting of difference sizes of scopes.

For purposes of mounting the unitary aluminum base or bar there must be tapped into the metal if the gun and head screws are added for accurate mounting purposes at a distance of 40 feet from a target, for example, there is obtained a very high accuracy when using this particular aluminum base or bar for gun mounting purposes so that it is more readily possible to "hit the bull's eye". The unit of the aluminum base or bar for sight and scope conversion mounting also can be used on double-barrelled guns (a phantom of such double barrel is in FIG. 1) with solid ribs, all high-powered rifles, pump-guns and automatic weapons and any other guns with a solid rib. The length of the aluminum base or bar itself can differ for different units each drilled and tapped to fit the same mounting bores on the gun thus equipped with an intermediate mounting member usable for sports, hunting, trap shooting and even some military applications. Sportsmen and gunsmiths can readily recognize the advantages of accuracy and interchangeable adaptability of the unitary aluminum base or bar mounting in combination with the sight and scope conversion mounting made possible by the features of the present invention.

The present invention is, of course, in no way restricted to the specific disclosure of the specification and drawings, but also encompasses any modification within the scope of the appended claims.

What is claimed is

1. A sight and scope conversion mounting for front and rear sight members as well as a pair of front and rear scope support loop pieces on fire arms including rifles, shotguns, pumps, and automatic weapons having at least one barrel and stock longitudinally spaced from each other as joined to an intermediate firing mechanism having an upper surface therebetween, said sight and scope conversion mounting comprising: a unitary metal base substantially rectangular shaped in planar configuration though having a curved upper surface in intermediate location provided with mounting screw holes therein, a flattened, reduced-size end integral with said base and recessed to receive in combination therewith a front sight member including a longitudinal rib and aiming projection, an elevated and enlarged end integrally joined to said base at a location axially and longitudinally remote from said reduced size end, said enlarged end having T-shaped recessing complementary to receive also in combination therewith a rear sight member with a transverse groove carrying a downwardly notched transverse plate secured in the transverse groove, and a continuous rail-like rib projecting downwardly and extending accurately longitudinally aligned along an underside of said base from end to end thereof for complementary fixation on the upper surface of the intermediate firing mechanism.

2. A sight and scope conversion mounting according to claim 1, wherein said base is made of aluminum and said rail-like rib squared for rigidity is continuous along the entire length of the underside of said base.

3. A sight and scope conversion mounting according to claim 2, wherein a slanted portion is provided as a transition between the curved upper surface and said reduced-size end.

4. A sight and scope conversion mounting according to claim 3, wherein said reduced-size end has both height and width thereof decreased from that of said base.

5. A sight and scope conversion mounting according to claim 4, wherein the T-shaped recessing of said enlarged end is aligned axially and longitudinally of the recess of said reduced-size end.

6. A sight and scope conversion mounting according to claim 1, wherein said base is arranged on a double-barrel shotgun.

7. A sight and scope conversion mounting according to claim 1, wherein the front and rear scope support loop pieces both have a "figure eight" upper and lower loop portions in a configuration to hold a scope in axially and longitudinally aligned upper loop portions thereof spaced parallel above said base.

8. A sight a scope conversion mounting according to claim 7, wherein lower loop portions are axially and longitudinally aligned for sight aiming to a target using the aiming projection and notched transverse plate at front and rear ends of said base.

9. A sight and scope conversion mounting according to claim 7, wherein the mounting screw holes allow interchangeable unit installation of said base independently of length and configuration of the barrel and stock of the fire arms.

10. A sight and scope conversion mounting according to claim 9, wherein the front and rear sight members as well as the front and rear loop pieces are made of plastic material.

* * * * *